US009679464B2

(12) United States Patent
Marra et al.

(10) Patent No.: US 9,679,464 B2
(45) Date of Patent: Jun. 13, 2017

(54) SYSTEM AND A METHOD FOR MONITORING HAND SANITIZING OPPORTUNITIES IN HOSPITAL WARDS

(71) Applicants: Sociedade Beneficente Israelita Brasileira Hospital Albert Einstein, São Paulo (BR); I-HealthSys Produtos Médicos Ltda-Me, São Carlos (BR)

(72) Inventors: Alexandre Rodrigues Marra, São Paulo (BR); Julio Cesar Martin Monte, São Paulo (BR); Marcelo Prado, São Carlos (BR); Eder Issao Ishibe, São Carlos (BR); Tales Roberto de Souza Santini, Muzambinho (BR); Caio Moraes Zanon, Brodowski (BR); Felipe Kermentz Ferraz Costa, São Carlos (BR); Guilherme Machado Gagliardi, São Carlos (BR); Renaldo Massini Junior, São Carlos (BR)

(73) Assignees: SOCIEDADE BENEFICENTE ISRAELITA BRASILEIRA HOSPITAL ALBERT EINSTEIN, São Paulo (BR); I-HEALTHSYS PRODUTOS MÉDICOS LTDA-ME, São Carlos (BR)

( * ) Notice: Subject to any disclaimer, the term of this patent is extended or adjusted under 35 U.S.C. 154(b) by 0 days.

(21) Appl. No.: 14/885,163

(22) Filed: Oct. 16, 2015

(65) Prior Publication Data

US 2016/0125723 A1 May 5, 2016

(30) Foreign Application Priority Data

Nov. 4, 2014 (BR) ..... 102014027568

(51) Int. Cl.
*G08B 21/00* (2006.01)
*G08B 21/24* (2006.01)

(52) U.S. Cl.
CPC ..... *G08B 21/245* (2013.01)

(58) Field of Classification Search
CPC ..... G08B 21/245
USPC ..... 340/573.1
See application file for complete search history.

(56) References Cited

U.S. PATENT DOCUMENTS

2003/0030562 A1* 2/2003 Lane ..... G08B 21/245 340/573.4
2004/0090333 A1* 5/2004 Wildman ..... G06F 19/3418 340/573.1
2006/0071799 A1* 4/2006 Verdiramo ..... G08B 21/245 340/573.5
2009/0051545 A1* 2/2009 Koblasz ..... G08B 21/245 340/573.1

* cited by examiner

*Primary Examiner* — Mark Rushing
(74) *Attorney, Agent, or Firm* — Patterson & Sheridan, LLP

(57) ABSTRACT

A system for monitoring the hand sanitizing opportunities in hospital wards (1), the system (1) comprising a plurality of sensors (8, 9, 10) arranged inside a ward (2), capable of detecting at least one hand sanitizing action according to a set of hand sanitizing opportunities, the system (1) further comprising at least one indication device (7) of the hand sanitizing action related to the set of hand sanitizing opportunities.
The present invention further relates to a method of monitoring the hand sanitizing opportunities in wards.

22 Claims, 14 Drawing Sheets

SYSTEM AND A METHOD FOR MONITORING HAND SANITIZING OPPORTUNITIES IN HOSPITAL WARDS

This application claims priority of the Brazilian patent application no. BR102014027568-1, filed on Nov. 4, 2014, the contents of which are integrally incorporated here by reference. The present invention relates to a system and a method for monitoring the hand sanitizing opportunities in hospital wards. More precisely, this is a system for detecting the need to clean one's hands at the so-called sanitizing moments.

DESCRIPTION OF THE PRIOR ART

Sanitizing the hands is one of the most important procedures to prevent hospital infections. Dispensers containing gel-alcohol most of the times are arranged at various points of a hospital, so that patients, visitors, coworkers and health professionals can sanitize their hands a number of times along the day.

Specifically in a hospital ward there are five moments at which one should sanitize the hands in order to diminish the possibility of transmitting hospital infection through one's hands.

These five moments are cited hereinafter: $1^{st}$) before contact with the patient; $2^{nd}$) before carrying out an aseptic procedure; $3^{rd}$) after a risk of exposure to body fluids; $4^{th}$) after contact with the patient; and $5^{th}$) after contact with areas close to the patient.

The prior art discloses a few methods and systems related to the control over sanitizing one's hands, but none of them is capable of monitoring the performance of this procedure at the so-called "five sanitizing moments".

For example, document BRPI 0905125-2 approaches a system and method for improving practices of sanitizing the hands. More specifically, it relates to a system and a method for optimizing the distribution and use of dispensers at a determined place.

BRPI 0905125-2 proposes a plurality of dispensers, each of them provided with a chip (memory). Additionally, transponders are used for reading said memory.

Thus, the description of BRPI 0905125-2 does not approach the possibility of using the proposed system and method to detect and monitor the sanitizing of the hands at the five sanitizing moments.

Another prior-art document is disclosed in BRPI 1105191-4. This document relates to a method and a system for monitoring the sanitizing correctness at a medical institution.

BRPI 1105191-4 makes use of a movement sensor (for detecting the presence of a user), a use sensor (for detecting the use of a dosing device), a receptor (for receiving the use/identification data and transmit such data to a central system), and a data processing system for generating reports on correctness.

The matter disclosed makes it possible to detect the sanitizing of the hands upon using a dosing device, but it is ineffective for monitoring, for instance, the sanitizing when the health professional handles an invasive device such as a catheter, or still when said professional establishes direct contact with the patient.

Thus, BRPI 1105191-4 does not enable one to monitor the sanitizing at the five sanitizing moments.

The prior art further discloses methods for determining a degree of performance of the practice of sanitizing the hands.

For instance, document BRPI 0611725-2 is based on a first number corresponding to the effective hand sanitizing actions, a second number representing a prediction of the hand sanitizing actions, and a third number representing the number of sanitizing events.

Thus, just as disclosed in document BRPI 1105191-4, said method is not capable of monitoring the hand sanitizing at the so-called five moments. In BRPI 0611725-2, sensors arranged only on the dosing devices themselves are employed, which makes it impossible to control and monitor a possible contact of the health professional with the invasive apparatus or devices and even with the patient himself.

Another drawback encountered in the prior-art documents cited above lies in the impossibility of informing the health professional on the need to sanitize his hands.

For instance, while taking care of the patient, the professional ends up performing certain activities and procedures that would need prior and/or subsequent sanitizing. However, very often this procedure is not performed.

It becomes then necessary to use an indication means to inform the professional (nurse, doctor) that he should sanitize his hands.

As described above, the prior art does not disclose any system or method capable of monitoring the sanitation of one's hands at the five sanitizing moments.

For example, there is no system capable of monitoring the need to sanitize the hands upon using an invasive device or still after contact with the patient.

Also there is no system that indicates to the health professional the need to sanitize his hands, such as a light signal arranged close to the patient's bed.

The prior art does not disclose either a system capable of monitoring and mapping the displacement of a health professional inside a hospital ward.

OBJECTIVES OF THE INVENTION

The present invention has the objective of providing a system for monitoring the hand sanitizing opportunities at hospital wards, capable of monitoring the need to sanitize the hands at the so-called five sanitizing moments.

A second objective of the present invention is to provide a system for monitoring the hand sanitizing opportunities so as to indicate to the health professional the need to sanitize his hands.

A third objective of the present invention is to provide a system for monitoring the hand sanitizing opportunities so as to indicate to the health professional the need to sanitize his hands after contact with an invasive device or medical equipment.

A fourth objective of the present invention is to provide a system for monitoring the hand sanitizing opportunities at hospital beds, which makes use of an infrared sensor for detecting heat zones inside the ward.

A fifth objective of the present invention is to provide a system for monitoring the hand sanitizing opportunities at hospital wards, which makes use of a movement sensor for detecting the handling of an invasive device by a health professional.

A sixth objective of the present invention is to provide a system for monitoring the hand sanitizing opportunities at hospital wards, configured so as to map and monitor the displacement of a health professional inside the ward.

BRIEF DESCRIPTION OF THE INVENTION

The objectives of the present invention are achieved by means of a system for monitoring the hand sanitizing opportunities at hospital beds.

Said system comprises a plurality of sensors arranged inside a hospital ward, capable of detecting at least one had sanitizing action according to a set of hand sanitizing opportunities.

The system further comprises at least one device for indicating the hand sanitizing action related to the set of hand sanitizing opportunities.

The objectives of the present invention are also achieved by means of a method for monitoring the hand sanitizing opportunities at hospital beds.

BRIEF DESCRIPTION OF THE DRAWINGS

The present invention will now be described in greater detail with reference to an example of embodiment represented in the drawings. The figures show.

DETAILED DESCRIPTION OF THE FIGURES

The system for monitoring the hand sanitizing opportunities at hospital beds 1, proposed in the present invention will be called only system 1 hereinafter, for the purpose of understanding the invention.

The system 1 comprises a plurality of sensors 8, 9, 10, arranged inside a hospital ward 2, capable of detecting at least one hand sanitizing action according to a set of hand sanitizing opportunities.

Said hospital ward 2 may be understood, by way of example, as being a room of an intensive treatment unit, a post-operation room, a maternity room or any other location at a hospital capable of accommodating a patient.

The hospital ward 2 may accommodate only one patent or may comprise more than one bed, thus receiving two or more patients.

With regard to the set of hand sanitizing opportunities, it should be understood as being the five hand sanitizing moments. As already mentioned, such moments are the moments when hand sanitation should be carried out within hospital ward.

The table below indicates which the five moments are and why one should perform the hand sanitation procedure.

TABLE 1

Set of hand sanitizing opportunities

| Five hand sanitizing moments | Why? |
|---|---|
| 1-before contact with the patient | To protect the patient, thus preventing transmission of microorganisms present on the hands of the professional and which may cause infections. |
| 2-before performing the aseptic procedure | To protect the patient, preventing transmission of microorganisms on the hands of the professional to the patient, including microorganisms from the patient himself. |
| 3-after a risk of exposure to body fluids | To protect the professional and the health-care environment in close proximity to the patient, preventing transmission of microorganisms from the patient to other professionals or patients. |
| 4-after contact with the patient | To protect the professional and the health-care environment, including the surfaces and the objects close to the patient, preventing transmission of microorganisms from the patient. |
| 5-after contact with the areas close to the patient | To protect the professional and the health-care environment, including surfaces and objects immediately close to the patient, preventing transmission of microorganisms from the patient to other professionals or patients. |

Figure 1:
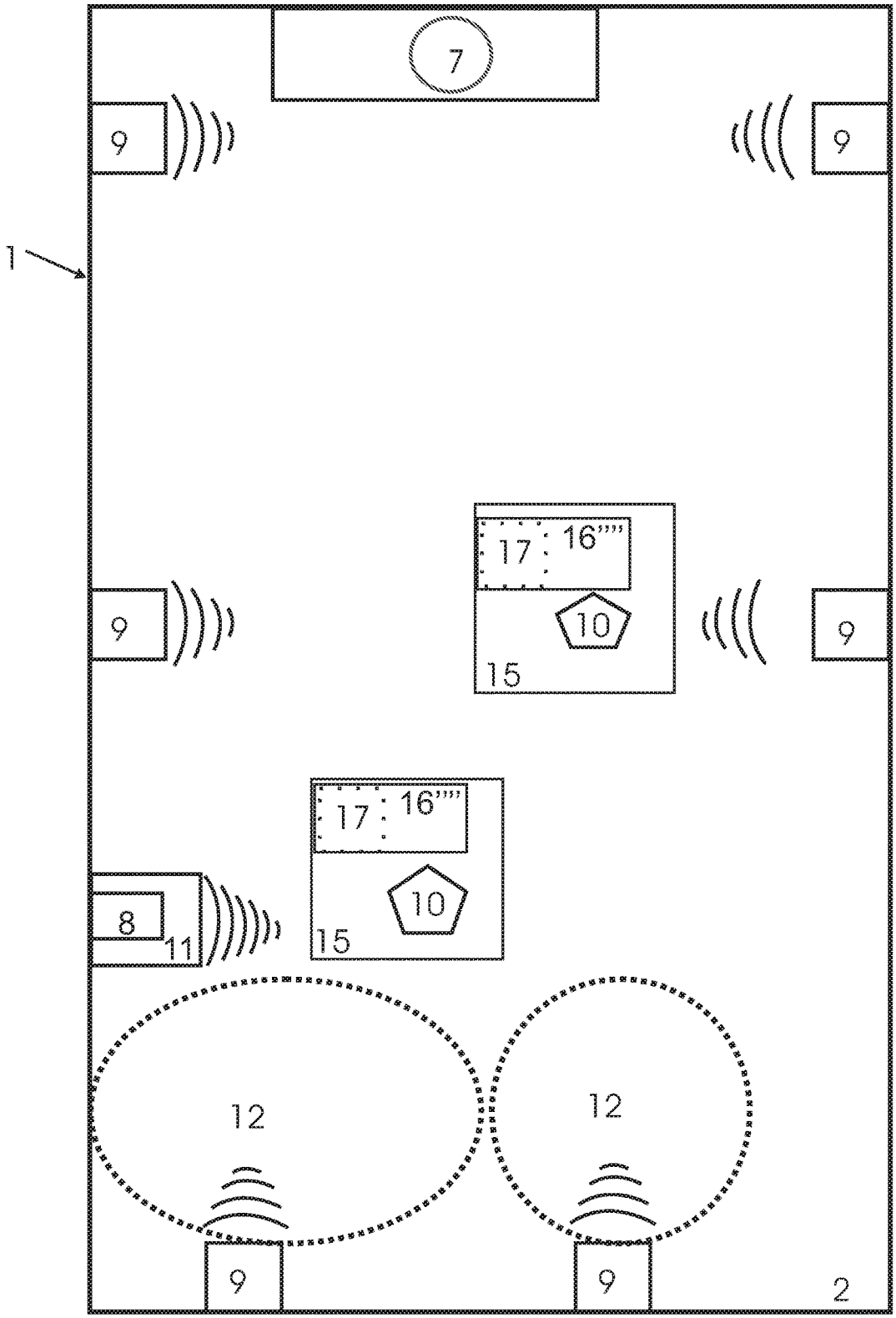
FIG. 1 is a block representation of the system for monitoring the hand sanitizing opportunities at hospital wards proposed in the present invention.

FIG. 1 is a block representation of a hospital ward comprising the system 1 proposed by in the present invention.

Basically, the proposed system 1 comprises a dosing device 11, an envelope 18 provided with infrared sensors 9 and a movement sensor 10 to detect an invasive device 15. With regard to the dosing device 11, it corresponds to a set composed of an actuation sensor 8, electronic board 16 with a non-volatile memory 20 and a radiofrequency module 17 of a dosing device 11 for dosing aseptic substance, for example, alcohol-gel.

Figure 2:
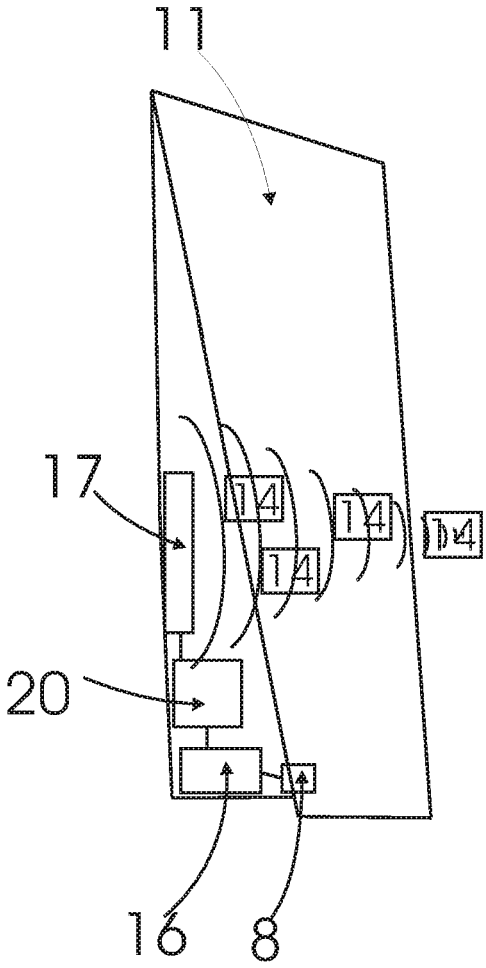
FIG. 2 is a side view of the dosing device to dose an aseptic substance by using the system proposed in the present invention.

A representation of the dosing device 11 is illustrated in FIG. 2. The latter comprises an electronic board 16 associated to the actuation sensor 8 and capable of identifying the exact moment, date and time, when the dosing device 11 was actuated. In other words, the actuation sensor 8, in conjunction with the electronic board 16 and the radiofrequency module 17 are capable of generating use date 14 of the dosing device 11.

Further in FIG. 2, one can see, connected to the electronic board 16 of the dosing device 11, a radiofrequency module 17 (receiver/transmitter) which is capable of identifying the person who has sanitized his/her hands. For this purpose, the user of the dosing device 11 should be using an identification device 26 (not shown in this figure), such as an identification tag, also provided with a radiofrequency module 17 equal to that arranged on the dosing device 11, and an electronic board 16' with a non-volatile memory 20' (not shown in this figure). The operation of said module 17 is preferably carried out at 900 MHz or 2.4 HGz.

If the person is not using an identification tag (identification device), the identification of the one who has sanitized his hands will not be possible, but it will be possible to determine the date and time when the sanitizing action has been performed.

More specifically, the actuation sensor 8 operates as a trigger, warning the electronic board 16, as soon as a sanitizing action has taken place at the dosing device 11. At this point, the radiofrequency module 17 will verify the existence of identification tags, as described above.

The dosing device 11 further comprises a non-volatile memory 20 to store the data of use 14 of this equipment.

Once the hand sanitizing action has taken place, the radiofrequency module 17 is configured so as to send such data of use 14 (with or without identifying who has sanitized his hands) to a plurality of infrared sensors 9 and movement sensors 10 arranged inside the hospital ward.

The data of use 14 should also be sent to an identification device 7 arranged close to the patient's bed. Said device 7 will be better described later in this specification.

With regard to the sensors 9, they correspond to infrared sensors 9, a block representation thereof is illustrated in FIG. 1 of the present application.

In this configuration of the present invention, six infrared sensors 9 are used. Obviously this is only a preferred characteristic, which should not be considered a limitation thereof.

Such sensors 9 are preferably arranged in an envelope 18 (not shown in FIG. 1), thus providing correct and safe housing for of the infrared sensors 9.

Each infrared sensor 9 is capable of detecting at least one heat emitting zone 12 inside the hospital ward, said heat emitting zone 12 being represented in FIG. 1 as well.

The infrared sensors 9 and, as a result, each of their heat emitting zones 12, are capable of tracking (mapping) the movement of a given person inside the ward 2 and, in conjunction with the actuation sensor 8, electronic board 16 and radiofrequency module 17 of the dosing device 11, capable of detecting the sanitizing event and determine whether such person has sanitized his hands according to the set of sanitizing opportunities, that is, the five sanitizing moments.

Thus, the infrared sensors 9 are capable of identifying, through the heat emitted by the human body, the number of people inside the ward 2 (in addition to the patient himself).

Other pieces of equipment that emit heat, as for instance, multiparameter monitors, infusion pumps, televisions and LCD screens may also be tracked by the sensors 9.

The mapping of people and pieces of equipment is possible, since the form of heat emission emitted differentiates them from each other. Further, it is possible to determine, on the basis of the design plan of the ward 2 and on of the image pattern, whether the person is moving, lying or standing. It is possible to identify even if the patient has gotten up to go to the toilet or to walk around.

Preferably, the envelopes 18 comprising the infrared sensors 9 should be arranged at the ceiling of the hospital ward 2. And by using more than one sensor 9, one can cover the whole area of the ward 2.

The exact identification of the pieces of equipment detected by the infrared sensors 9 is possible, since the latter can be identified via radiofrequency, for instance, by using the ZigBee or Bluetooth technology.

In this case, said pieces of equipment should comprise a radiofrequency module 17 (equal to the radiofrequency sensors (modules) 17 mentioned before) and configured so as to emit, at regular time intervals, their identification number, thus making it possible to determine exactly which piece of equipment is in a determined heat emitting zone 12 of an infrared sensor 9.

To enable an exact identification of the equipment, the envelopes 18 should comprise, in addition to the infrared sensor 9, an electronic board 16" and a radiofrequency module 17, for communication with the radiofrequency modules 17 arranged on the pieces of equipment.

Figure 3:
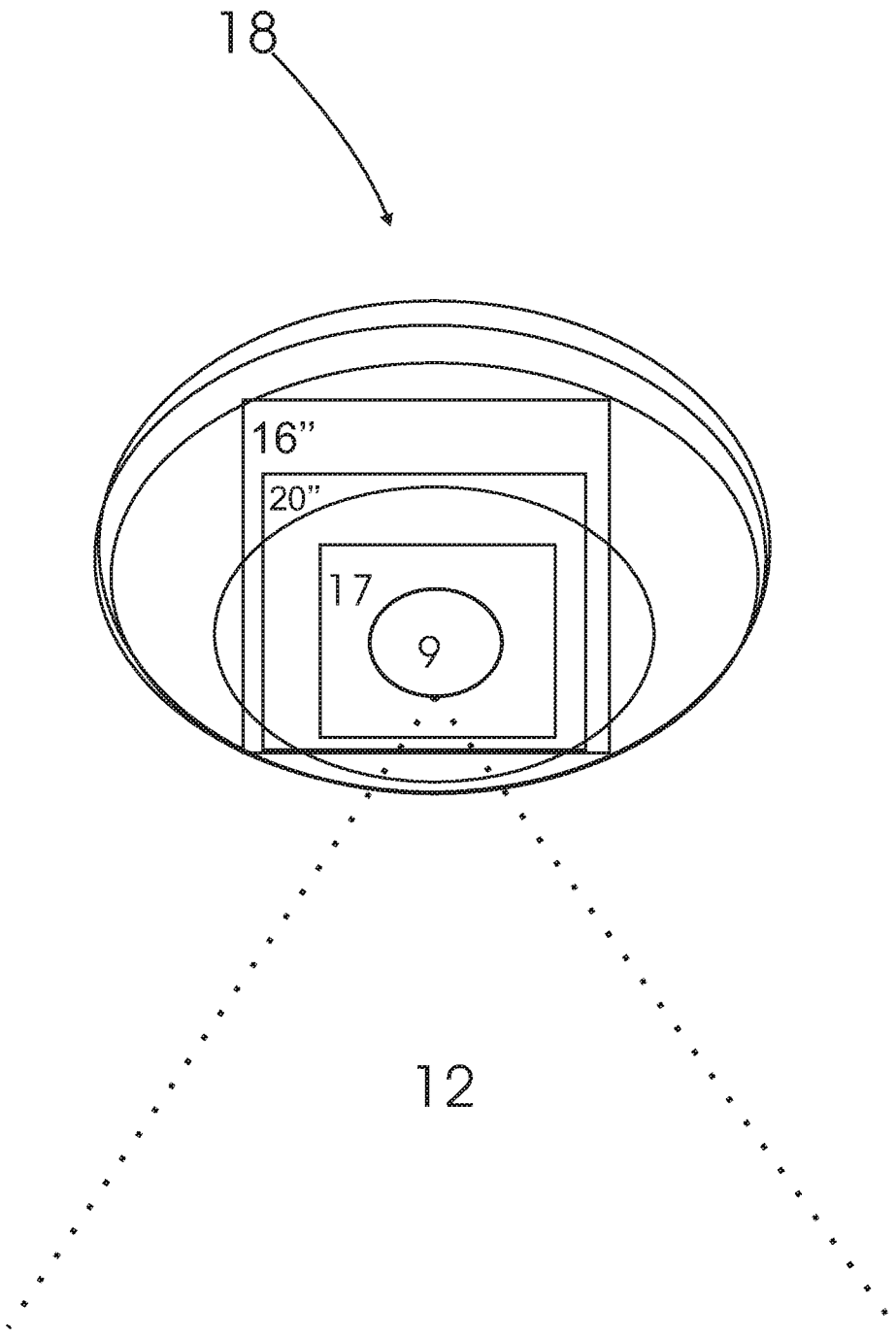
FIG. 3 is a perspective view of the envelop that comprises the infrared sensor of the system proposed in the present invention.

FIG. 3 is a preferred representation of the envelope 18 used in the system 1 proposed in the present invention. Herein one observes the infrared sensor 9, the heat emitting zone 12 detected by it, the radiofrequency module 17 (receiver/transmitter) and the electronic board 16".

The fixation of the envelope 18 to the ceiling of the ward 2 may be made by using conventional fixing elements such as screws. Alternatively, the back portion of the envelope 18 may comprise an adhesive means for fixation to the ceiling of the ward 2. Other fixation forms known from the prior at are also acceptable.

The system 1 proposed by the present invention is further capable of detecting the exact moment when a health professional has handled an invasive device 15, as for example a catheter.

For this purpose, the catheter 15 should comprise a movement sensor 10 arranged on one of its surfaces. In this preferred embodiment, the movement sensor 10 is an accelerometer, thus enabling one to detect the moment when the catheter 15 is handled by the healthy professional.

Like the infrared sensors 9, a radiofrequency module 17 (receiver/transmitter) may also be coupled to the catheter 15, as well as an electronic board 16" for exact identification of the person who is handling the invasive device (catheter 15). For this purpose, the medical professional should be using an identification device 26 (identification tag), also provided with a radiofrequency module 17 and an electronic board 16'.

Although the above example has been given with reference to a catheter 15, it is important to mention that the arrangement of a movement sensor 10 on this equipment specifically should not be considered a limitation of the invention.

Basically any equipment arranged inside the hospital ward 2 may receive the movement sensor 10, as for instance, catheter supports, probes, infusion apparatus or pumps, or any other type of equipment used on invasive procedures.

Further, the specific use of an accelerometer should be considered a preferred embodiment of the present invention, so that a capacitive touch sensor or a force sensor could also be used.

The system 1 described before, comprising a dosing device 11 provided with an actuation sensor 8, electronic board 16 with non-volatile memory 20 and radiofrequency module 17, envelope 18 provided with infrared sensors 9, radiofrequency module 17, electronic board 16" with non-volatile memory 20" and invasive device 15 with movement sensor 10, radiofrequency module 17 and electronic board 16"" enables one to determine precisely the location of a health professional inside the hospital ward 2, whether he is in contact with the patient or if he has handled some invasive device 15.

As a result, it can be determined whether a hand sanitizing action has been performed according to the set of sanitizing opportunities (5 moments) mentioned before.

Additionally, the performance or non-performance of hand sanitizing action is indicated to the health professional through an indication device 7 arranged preferably close to the patient's bed.

In this preferred embodiment of the present invention, said indication device 7 is configured as a light signal that will indicate in green color that a sanitizing action has taken place, and will indicate in red color that a sanitizing action has not taken place.

Figure 4:
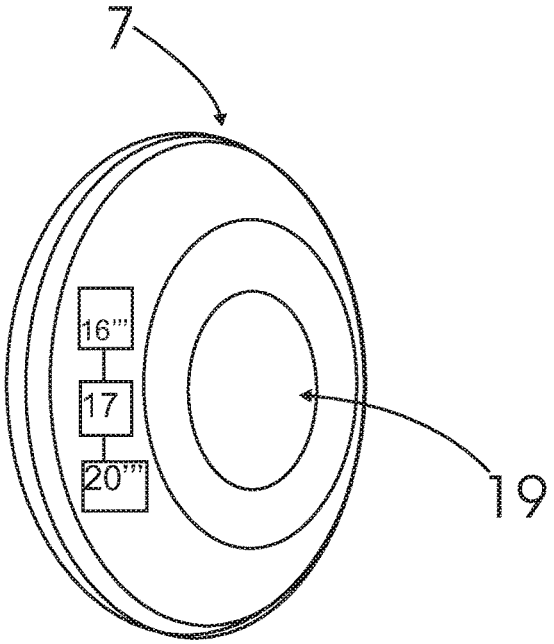
FIG. 4(*a*) is a perspective representation of a preferred embodiment of the device for indicating the hand sanitizing action used in the present invention and FIG. 4(*b*) is an alternative configuration of this indication device.
Figure 4:
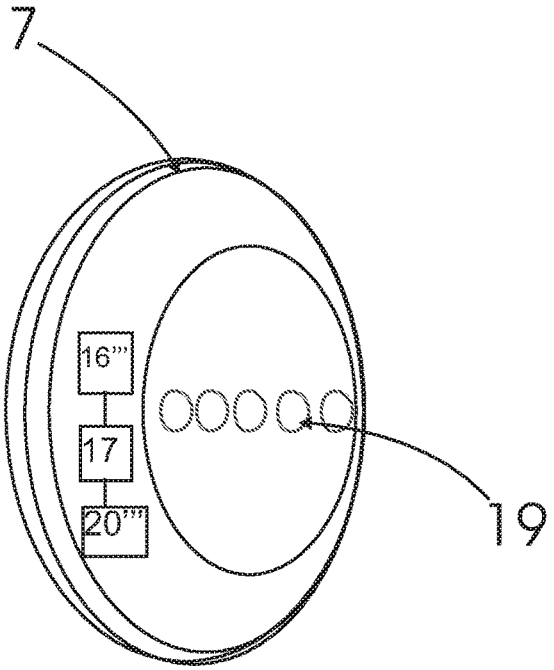

A representation of the indication device 7 preferably proposed in the present invention is illustrated in FIG. 4 (*a*). The green or red light signal is views in region 19.

Additionally, one observes that the indication device 7 also comprises the radiofrequency module 17 for communication with the sensors of same type arranged in the envelope 18, on the dosing device 11 and catheter 15 (or on any other invasive equipment). Further, one observes an electronic board 16''' associate to the radiofrequency module 17 of the indication device 7.

The indication device 7 can operate either connected directly to the power socket or by means of batteries, the fixation thereof in a region adjacent to the patient's bed may be made by using conventional screws or any other fixation means known from the prior art.

An alternative configuration for the indication device 7 is illustrated in FIG. 4 (*b*). In this case the green or red signal is made individually for each of the five sanitizing moments.

Other configurations for the indication device 7 are acceptable, for example, such indication might be made directly on the identification tag of the professional, by means of a light signal, or alternatively said identification tag might be provided with a device capable of emitting a slight vibration at the moment when the sanitizing action should take place or a sound signal indicating the sanitizing action.

Figure 5:
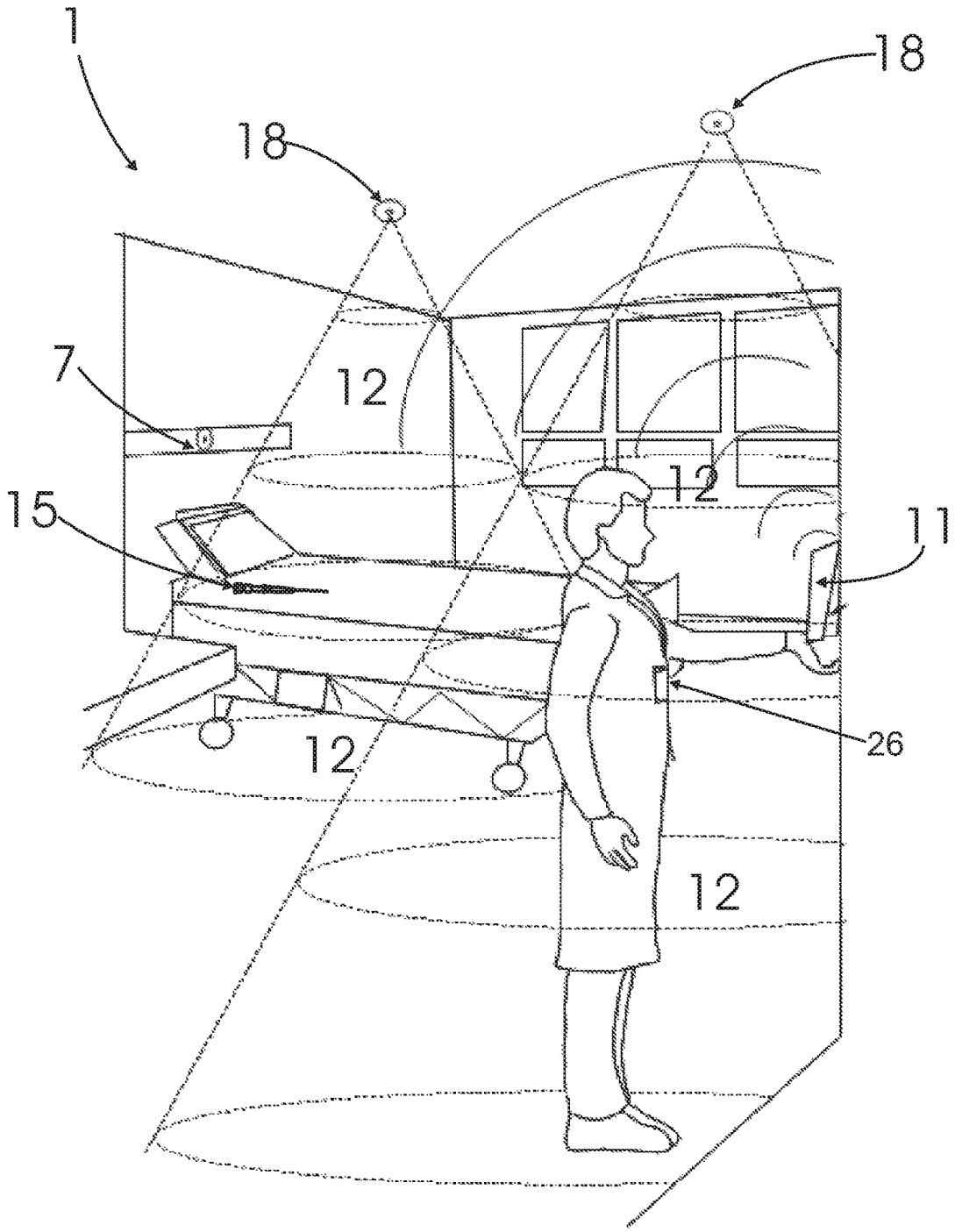
FIG. 5 is a perspective view of a hospital ward comprising the sanitizing system proposed in the present invention.

FIG. 5 is a perspective representation of the ward 2 comprising the system 1 proposed in the present invention.

Herein one can see the dosing device 11 disclosed in FIG. 2 fixed to a wall of the ward 2 and a health professional performing hand sanitation action.

In FIG. 5, one further observes the envelops 18 which protect the infrared sensors 9 installed in the ward 2, each of the sensors 9 detecting the respective heat emitting zones 12.

For a better understanding of the invention and with a view not to pollute the illustration of FIG. 5 too much, only two infrared sensors 9 are represented therein. As already mentioned, one should use the necessary number of sensors 9 to cover the total area of the ward 2.

One can further see, in FIG. 5, the indication device 7 positioned close to the patient's bed, capable of indicating, by means of a green or red light signal, whether the sanitizing action has taken place.

A representation of the invasive device 15 comprising the movement sensor 10 is also illustrated in this figure.

Once the main components that integrate the system 1 proposed in the present invention have been disclosed, one will now describe an example of operation of this system, considering the performance of a medical procedure by a health professional for the patient accommodated in the hospital ward 2.

One considers that a health professional will sanitize his hands by using the dosing device 11 highlighted in FIG. 2 of the present application.

At the moment when the actuation sensor 8 is pressed, the electronic board 16 will identify the date and time when such hand sanitizing act has taken place. The radiofrequency module 17 will transmit the data of use 14 of this hand sanitizing act to the infrared sensors 9 and to the indication device 7 close to the patient's bed. As already mentioned, the actuation sensor 8 operates as a trigger, sending a command to the electronic board 16 as soon as the dosing device 11 is actuated.

More specifically, the data of use 14 are transmitted from the radiofrequency module 17 present on the dosing device 11 to the sensors of same type present in the envelope 18, on the indication device 7 and on the catheter 15.

The data of use 14 are transmitted via radiofrequency for identification of the occurrence of a sanitizing action. Such data 14 are then interpreted by a software linked to the system 1 to determine whether the hand sanitizing action has taken place or not, according to the set of sanitizing opportunities (five sanitizing moments).

In other words, the data of use 14 of the dosing device 11 are compared with the heat emitting zones 12 of the infrared sensors 9.

The data of use 14 may envisage the indication of date and time when a sanitizing action has taken place, or, if the professional is using an identification device 26, also provided with a radiofrequency module 17, in addition to the date and time the data of use 14 will also comprise the exact identification of who has sanitized his hand.

Figure 6:
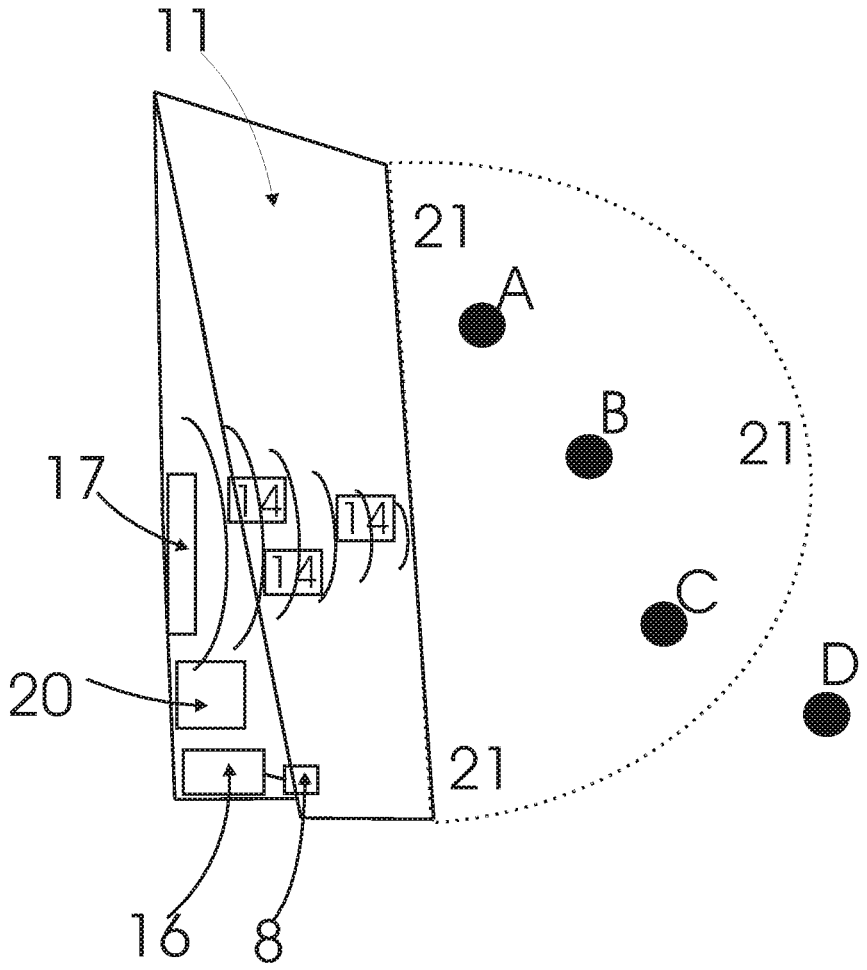
FIG. 6 is a representation of the dosing device used in the system proposed in the present invention, indicating its minimum power threshold.

For an adequate operation of the system 1 and methods proposed, specifically with respect to the dosing device 11, a region of operation of the radiofrequency module 17 should be calibrated, that is to say, a minimum power threshold 21 of the radiofrequency module 17 should be established, as indicated in FIG. 6 of the present patent application.

The area delimited by the minimum power threshold 21 indicates the region in which the signal emitted by the identification tag will be detected, for instance, the radiofrequency module 17 will be capable of detecting the signal emitted by the identification tags of the users A, B and C, not that of the user D, who is out of the area delimited by the minimum power threshold 21, according to FIG. 6.

Figure 7:
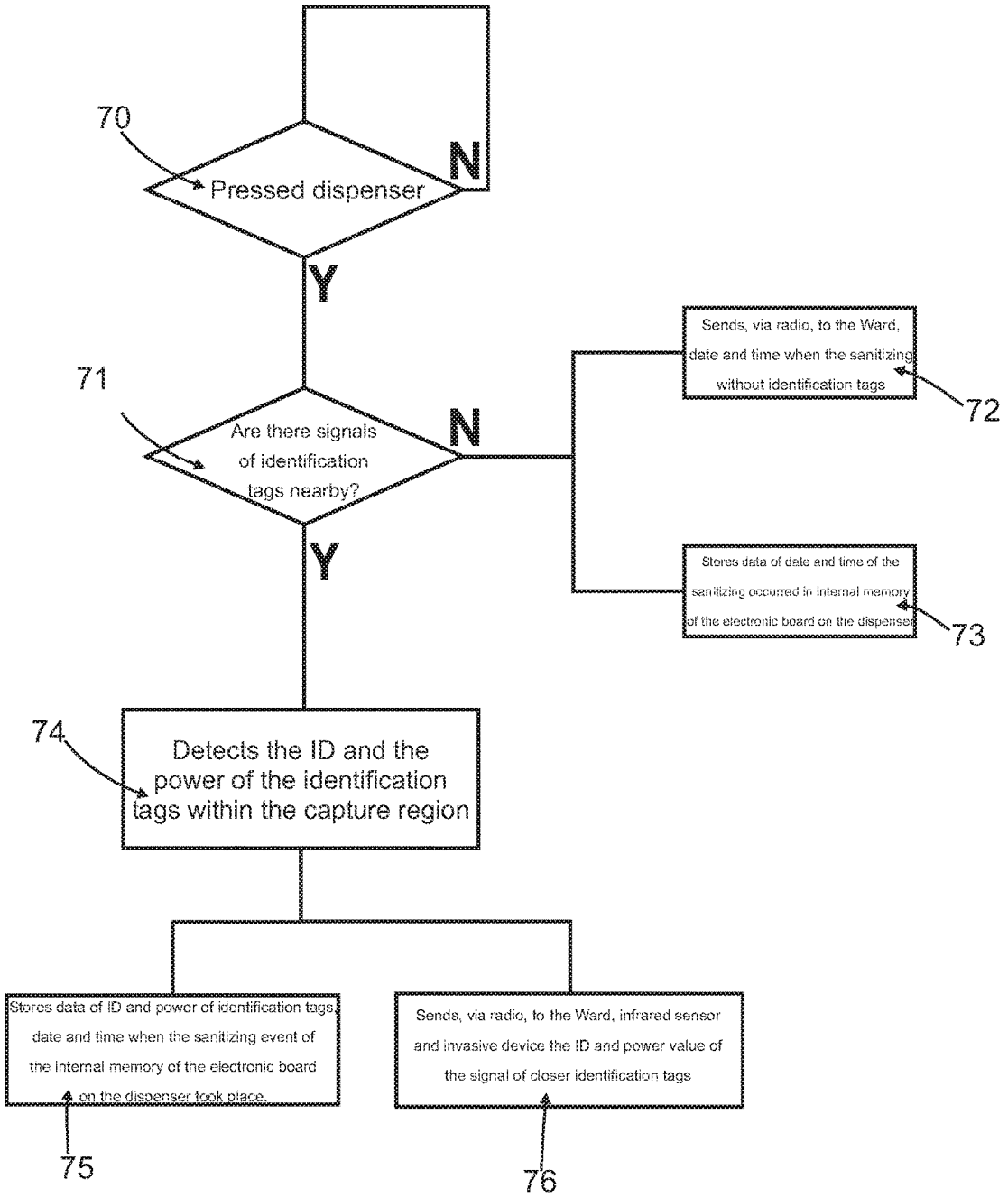
FIG. 7 represents a flowchart of operation of the dosing device used in the present invention.

FIG. 7 represents a flowchart of the methodology of operation of the dosing device 11. Herein one observes a first condition step 70 in which the actuation sensor 8, the electronic board 16 and the radiofrequency 17 will detect whether the user has pressed the dosing device 11. If not, the step 70 will be verified again until a hand sanitizing action has taken place.

When said action occurs, the step 71 will verify whether there are identification tag signals (identification devices) nearby, that is to say, with power above the minimum threshold 21, which would represent users within the area indicated by the minimum threshold 21, that is, within the minimum power threshold 21.

In other words, said step will verify whether there are signals coming from the identification device 26 (identification tag), such signals being obviously transmitted via radiofrequency.

If so, said software will detect the ID (identification of who has sanitized his hands) and the power of the identification tags within the minimum threshold 21 (step 74) and then at step 75 it will store the identification (ID) data and power of the identification tags, in addition to the date and time when the hand sanitizing has taken place. Such stored data represent the data of use 14.

Subsequently, as indicated in step 76, the data of use 14 will be sent via radiofrequency to the identification device 7, to the infrared sensor 9 and to the invasive device 15.

If the output of the condition step 71 is negative, this will indicate that there is no identification tag within the minimum power threshold 21. In this way, the data of use 14 of the dosing device 11 will be stored in the internal memory 20 of the electronic board of the dosing device 11 (step 73).

Further, such data of use 14 will be sent via radiofrequency to the indication device 7 (step 72). In this case, the data of use 14 will comprise only the date and time of the hand sanitizing action without identification of who has sanitized his hands.

The detection of an identification tag by the indication device 7 arranged close to the patient's bed takes place in a similar way as that of the dosing device 11.

For this purpose, one may divide an area adjacent the patient's bed 23 into a number of regions, so that each region will comprise a pre-defined distance from the identification device 7. The total area delimited will define a zone of capturing the identification tag 22.

From the determined zone (or pointing) the identification will not be considered to be close to the bed 23. In this way, one can establish a threshold for detection of the identification tag by the indication device 7.

Figure 8:
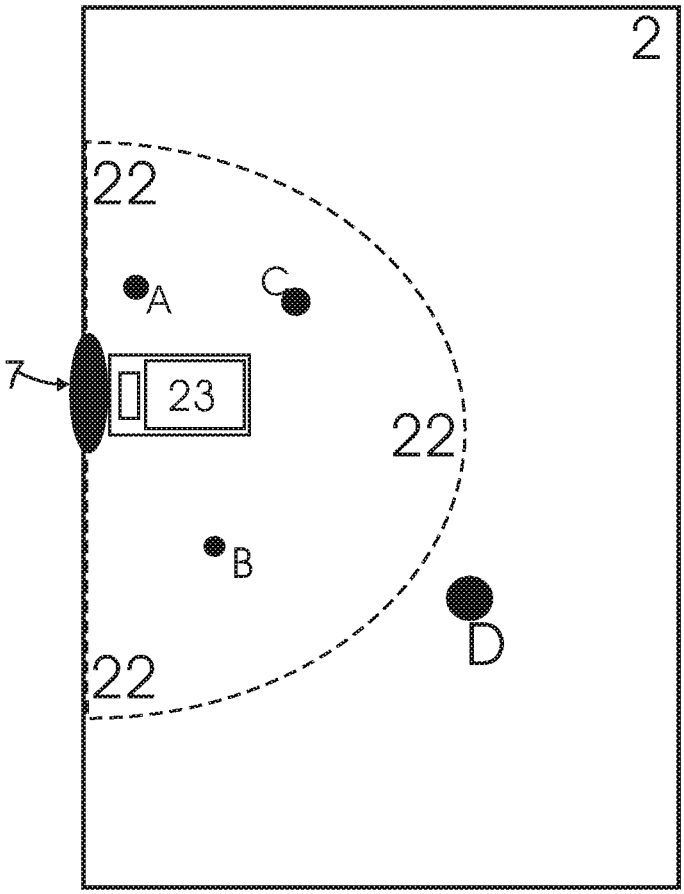
FIG. 8 is a representation of the identification-card capture zone of the indication device used in the present invention.

For example, FIG. 8 is a representation of the hospital ward 2 indicating the zone of capture of the identification tag 22 of the indication device 7. One observes that the zone 22 involves the patient's bed 23.

Considering the users A, B and C, one verifies that they are within the zone of capture of the identification tag 22 detected. As a result, their identification tags will be considered to be close to the patient's bed. On the other hand, the user D will not be detected by the indication device 7. In other words, he will not be regarded as being close to the patient's bed 23.

Figure 9:
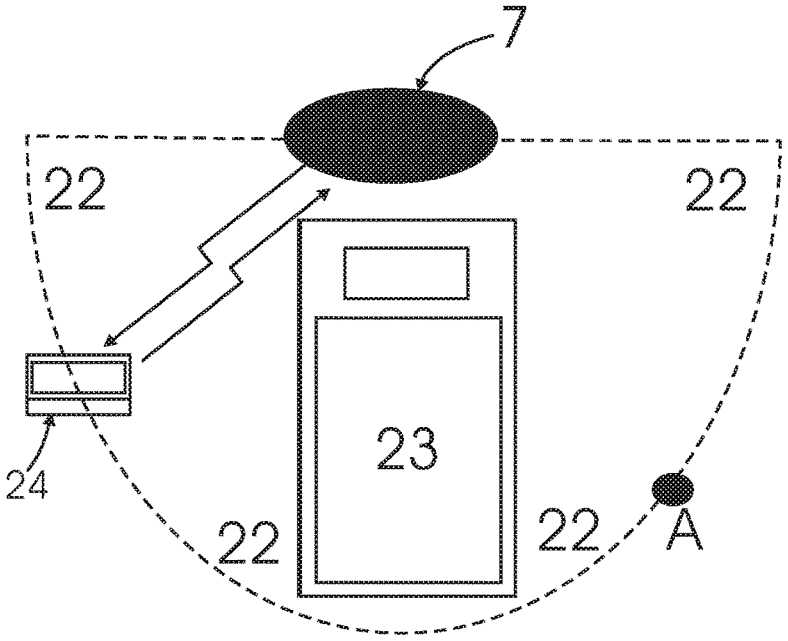
FIG. 9 is a representation of the identification-card capture zone detected by the indication device used in the present invention.

For calibration of the zone 22 to be detected by the radiofrequency module 17 of the indication device 7, that is to say, for calibration of the maximum area to be detected by the radiofrequency module 17 of the indication device 7, the following steps should be carried out, with reference to FIG. 9:

- defining a region close to the patient's bed 23, in which one desires to detect the identification tag, thus establishing the zone of capture of the identification tag 22;
- positioning a user A using an identification tag in the threshold of the zone of capture of the identification tag 22 and measuring the power captured by the indication device 7; the power measured is then sent to a computer 24, for instance, via ZigBee connection;
- the computer sends the information relating to the signal power of the identification tag to the indication device 7; this value will be used as a parameters for definition of the zone of capture of the identification tag 22.

A "maintenance" or "calibration" mode for the indication device 7 during this procedure may be established. Once this has been made, the indication device 7 may be reestablished to the normal operation mode.

Figure 10:
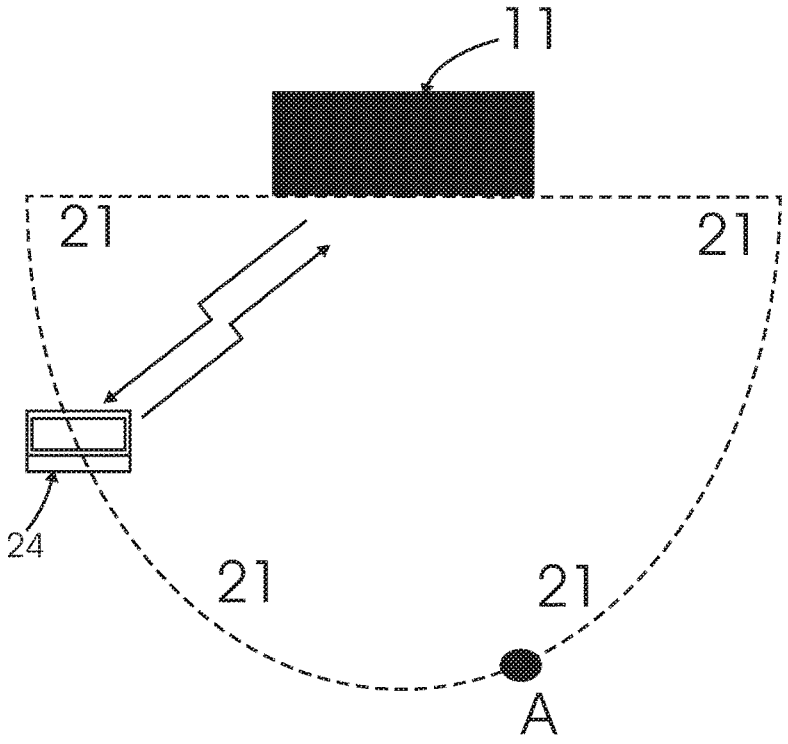
FIG. 10 is a representation of the minimum power threshold of the dozing device sued in the present invention.

For calibration of the radio frequency module 17 of the dosing device 11, one should carry out steps equivalent to those mentioned above, thus determining the minimum power threshold 21, as shown in FIG. 10 of the present application.

Figure 11:
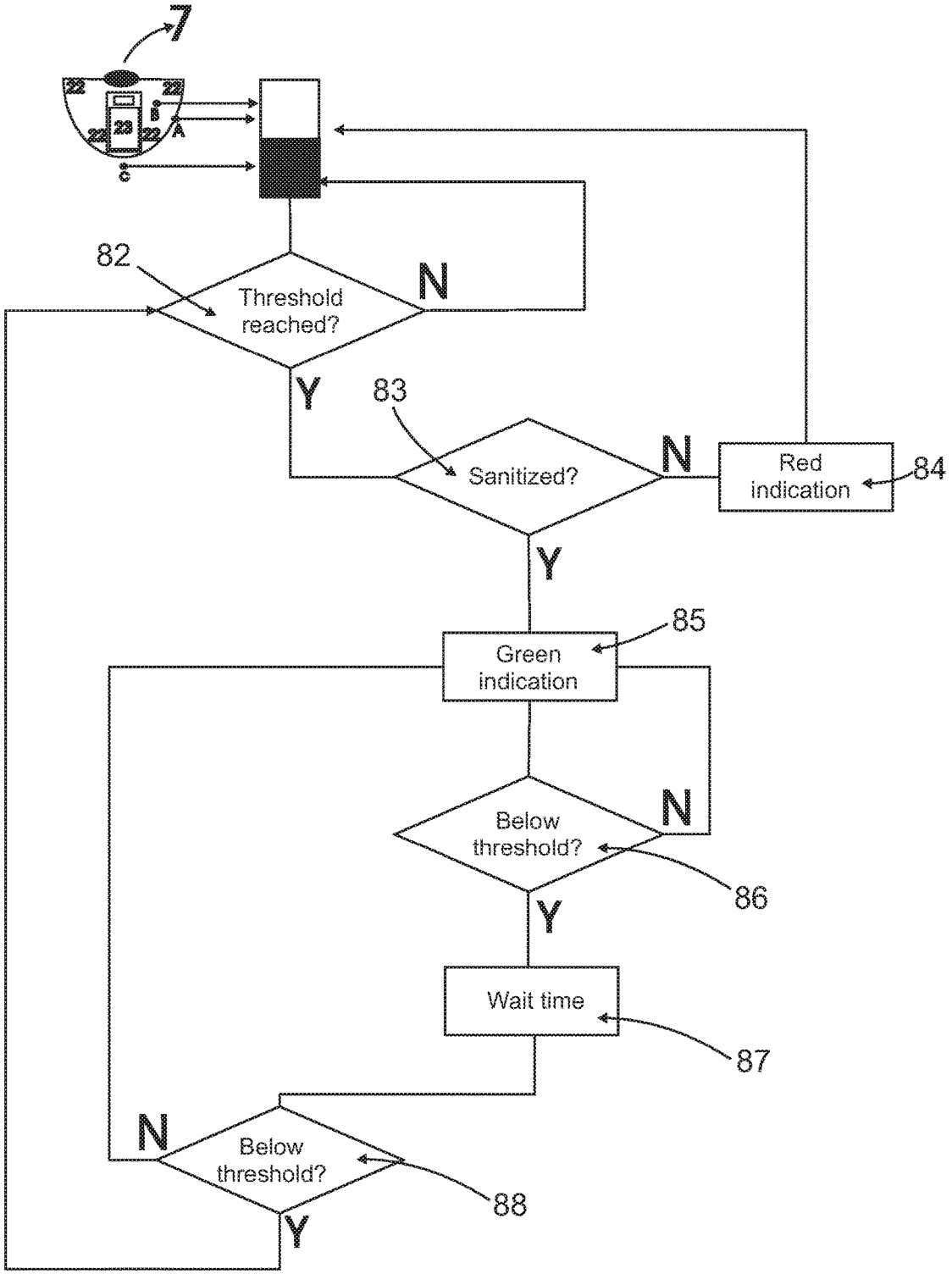
FIG. 11 is a flowchart exhibiting the steps for detecting a user using an identification card close to the indication device.

With respect to FIG. 11, it represents a flowchart exhibiting the steps for detection of a user with an identification tag close to the radiofrequency module 17 of the indication device 7. Such steps are also carried out for detection of the approximation of an invasive device 15 close to the patient's bed 23.

The methodology will begin at the moment when the user gets into the zone of capture of the identification tag 22, as indicated by users A and B in FIG. 11. More specifically, the condition step 82 inquires whether the threshold of the zone of capture 22 has been reached.

If so, a new condition step 83 is processed, which inquires of the user who entered into the zone of capture 22 has sanitized his hands. If not, a red light indication will be displayed on the indication device 7 (step 84) and the methodology exhibited will be restarted.

In the positive case, a green light indication will be displayed on the indication device 7 (step 85).

Then, the step 86 inquires if the user is out of the zone of capture of the identification tag 22. If not, (the user within the zone 22) the green indication will be displayed on the device 7.

If to (user out of the zone 22, a time of wait, preferably of 1 minute, will be processed (step 87) before the sequence to the next condition step 88, in which it is again inquired if the user of out of the zone of capture 22.

If not, the step 85 will be processed again and the green indication will be displayed on the indication device 7. If so, it will indicate that the user has left the zone of capture 22 for a time period longer than the wait time. In this case, the process will be restarted from step 82.

The wait time processed in step 87 is carried out for making sure that the user has not left the zone of capture 22 for a very short time period and then returned.

Thus, one awaits for one minute an then goes on to the step 88 if the reply to step 88 is again positive, there will be no doubt that the user has really left the limits of the zone of capture 22.

Obviously, the wait time of one minute is only a preferred value of the invention and should not be considered a limitation thereof.

The flowchart presented in FIG. 11 shows the steps for detection of only one user with an identification tag 26. In the case of two or more users with identification tags 26, the preferred light indication on the indication device 7 will be red, that is to say, in the case of two or more users with identification tags 26, if at least one of the users has not sanitized his hands at the dosing device 11, the red light will displayed on the indication device 7.

With regard to the infrared sensors 9 in conjunction with the software, so that these can establish the heat emitting zone 12 and, as a result, track the movement of a determined person, these sensors use image detection and analysis technique such as segmentation, recognition and follow-up.

Figure 12:
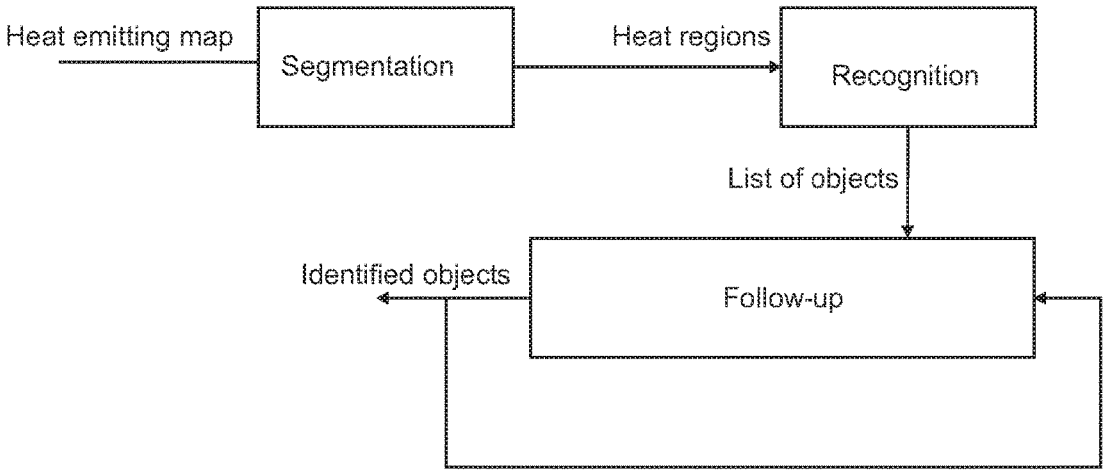
FIG. 12 is a block representation of the algorithm to be carried out by the infrared sensors used in the present invention.

Specifically with respect to the follow-up of objects, the notion of continuity along the time is carried out through an iterative algorithm, as shown in FIG. 12.

Taking as reference specially FIG. 12, the operation of the infrared sensors 9 begins when a user gets into the heat emitting zone 12 detected by the sensors 9.

At this moment, the infrared sensor 9 captures the area covered by the heat emitting zone 12 and generates a heat emission map processed at the segmentation step.

At the segmentation step, the heat emission map is processed (noises are eliminated) to outline and separate the heat regions (objects and pieces of equipment). These heat regions are then processed by the recognition step.

The position, the size and the intensity of heat of each of the hat regions are obtained in the recognition step. The heat regions (objects or pieces of equipment) are listed and processed by a follow-up step.

At the latter step, the similarity between the objects listed by the recognition step and the objects obtained at a previous instant is analyzed, it being then possible to identify and track each of the users or pieces of equipment.

Figure 13:
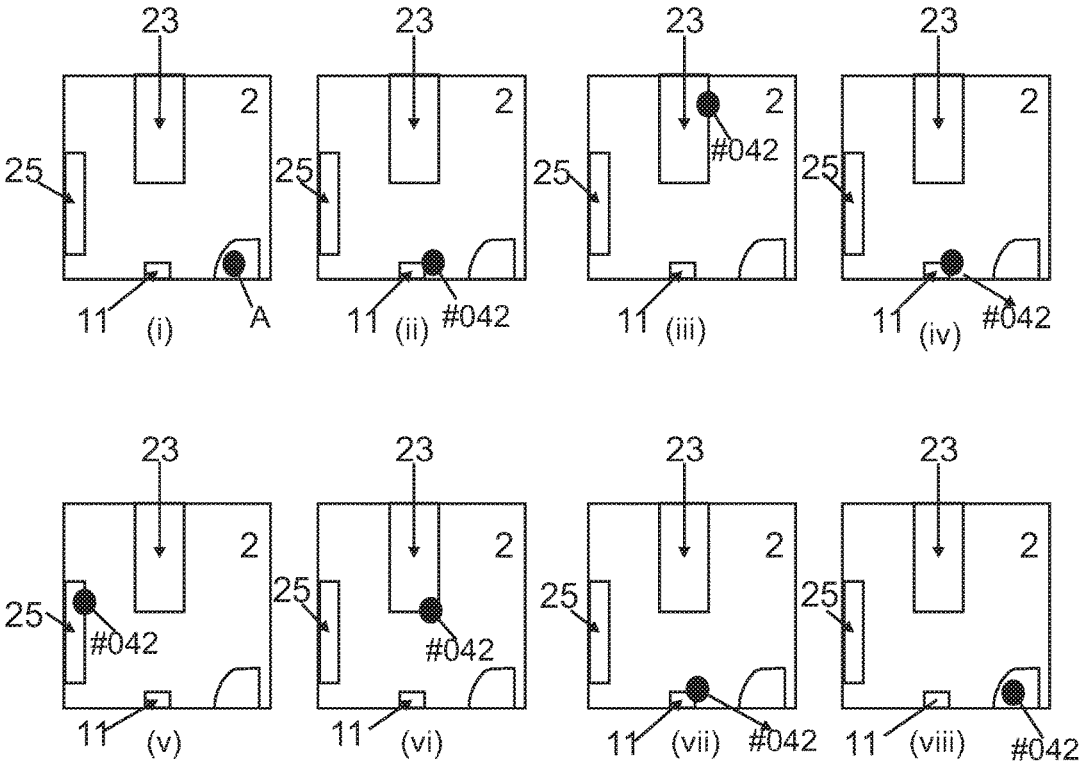
FIG. 13 is a block representation indicating the displacement of a user within the hospital ward according to the system and method proposed.

In a practical example of use in which the five sanitizing moments take place in the hospital ward 2 provided with the monitoring system 1 according to the present invention, at least three objects of the ward 2 should be established, the positions of which are known and then previously registered on the software. As shown in FIG. 13, these three objects are respectively dosing device 11, bed 23 and counter 25.

The displacement of user A in the hospital ward 2 will be indicated in FIGS. 13 (*i*) to (*viii*). FIG. 13 (*i*) represents the moment when the user A gets into the ward 2. At this moment, his displacement will be monitored by the infrared sensors 9.

When the user enters into the ward 2, the software recognizes the new object (since the latter was not previously registered) and associated it with an arbitrary name generated automatically and that enables one to follow up (monitoring) inside the hospital ward 2. In this preferred example, the name generated will be only give by way of example, letter "A".

FIG. 13 (*ii*) illustrates the user A (a new object detected by the infrared sensors 9) close to the dosing device 11 to perform the hand sanitizing action. At the moment when the hand sanitizing takes place, the sanitizing system 1 registers the event and associates it with the identification of the user A.

In parallel, at the moment when the dosing device is actuated, the methodology shown in FIG. 7 is carried out by the system 1 proposed ion the present invention.

Subsequently, a registration number should be established to the user A (object). In this preferred case, one can identify the user A with the same identification (ID) number of the identification tag 26, for example #042. If the user A is not using the identification tag 26, a provisional and single identification number will be attributed to the user A.

Once the sanitizing action of the user A (doctor of registration #042) has been registered, at the moment when the latter comes close to the patient's bed 23, the first sanitizing moment will be confirmed, that is, before contact with the patient, as shown in FIG. 13 (*iii*). For this purpose, the system 1 proposed carries out the methodology indicated in FIG. 11 of the present application.

Later, the infrared sensors 9 detect the displacement of the user A to the dosing device 11 again (FIG. 13 (*iv*)) and, when a new sanitizing action is performed, the data of use 14 will be compared with the data of use 14 referring to the first sanitizing action.

As a result, the third (after contact with the patient) and fourth (after risk of exposure to body fluids) sanitizing moments will now be registered by the system 1.

The approach of the user A to perform the aseptic procedure (FIG. 13 (*v*)) will be monitored by the infrared sensors 9. In this case, since one already knows that the sanitizing action has taken place before, the second sanitizing moment will be registered (before the aseptic procedure is performed).

Subsequently, the sanitizing system 1 and consequently the infrared sensors 9 detect the displacement of the user A (doctor of registration #042) as far as the patient's bed 23.

Then, a new sanitizing action is performed and, as a result, the third and fourth sanitizing moments will again be detected (FIG. 13 (vii)).

Finally, as shown in FIG. 13 (viii), the user A leaves the ward 2 and, while the doctor (registration #042) is sanitizing his hands, the fifth sanitizing moment is registered, that is to say after contact with the areas close to the patient.

In conjunction with the mapping made by the infrared sensors 9, the movement sensors 10 detect the exact moment when the invasive device 15 has been handled.

Figure 14:
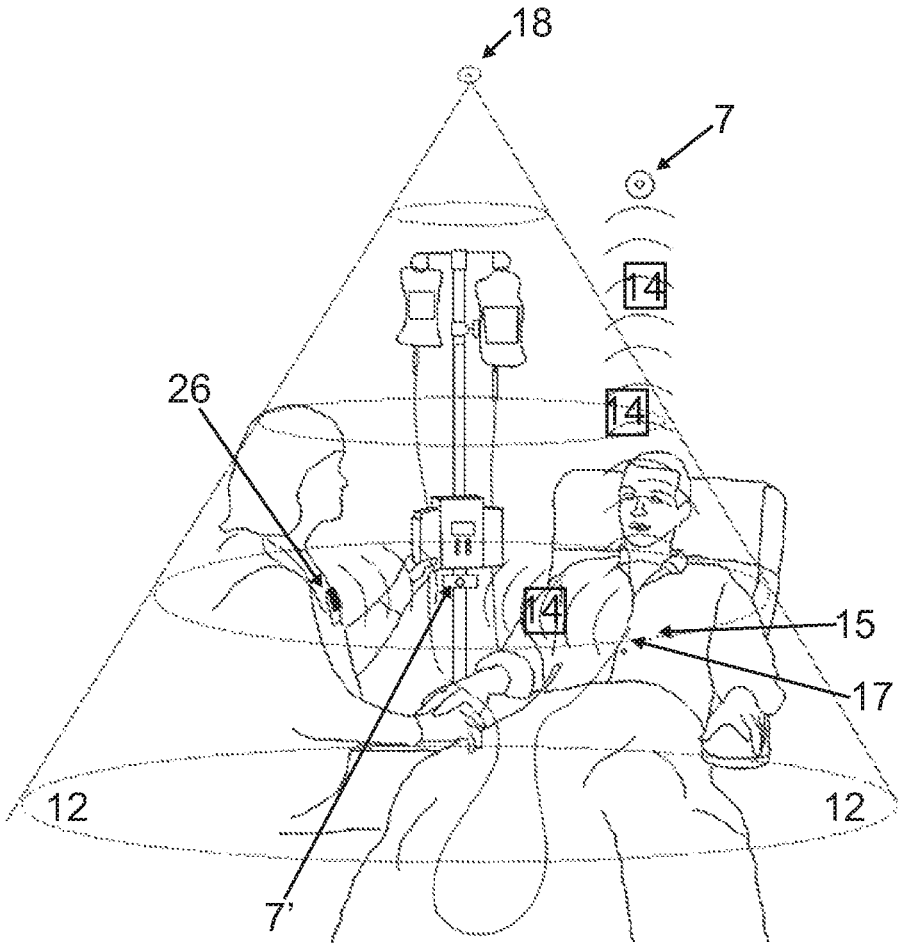
FIG. 14 is a perspective representation of a hospital ward comprising the monitoring system proposed in the present invention.

FIG. 14 is a representation of a patient accommodated in the ward 2, receiving a catheter 15. As already mentioned, the catheter 15 comprises a movement sensor 10 capable of detecting when this device is handled.

When such handling takes place, the radiofrequency module 17 arranged on the catheter will send the data of use 14 to the indication device 7 and, more specifically, to the radiofrequency module 17 of the indication device 7, located close to the patient's bed.

Alternatively, the data of use 14 may be transmitted to indication devices arranged, for instance, on a rod of the infusion pump equipment, such as an indication device 7'.

Regardless of the location of the indication device 7, the radiofrequency module 17 present on it will be capable of identifying which identification tag 26 is closer to the bed and, as a result, will carry out the identification (green/red) if the sanitizing action has taken place before the handling of the catheter 15.

Further, as already mentioned, if the health professional is not using the identification tag 26 at the moment when the catheter 15 is handled, the green/red light indication will be displayed. However, the system 1 proposed in the present invention will not be capable of identifying who has sanitized his hands, but only whether the sanitizing action has taken place or not.

The detection by the indication device 7 (or 7') is carried out according to the technology indicated in FIG. 11 of the present application.

Thus, the data of use 14 of the dosing device 11 with the handling of the device 15 will be compared, and a light indication will be displayed on the indication device 7.

For instance, if the health professional has handled the catheter 15 and then moved as far as the patent to administer a medicament without sanitizing his hands in this time interval, a red light signal will be displayed on the device 7.

Said system 1 may be kept in operation integrally, or alternatively it may remain at rest (sleep mode) until a first sanitizing action is detected by the actuation sensor 8 of the dosing device 11. At this moment, the mapping of the infrared sensors 9 will be started.

With regard to the identification device 26 (identification tag), it should preferably have autonomy to operate for a minimum time period of 24 hours, fed by disposable or rechargeable batteries.

Figure 15:
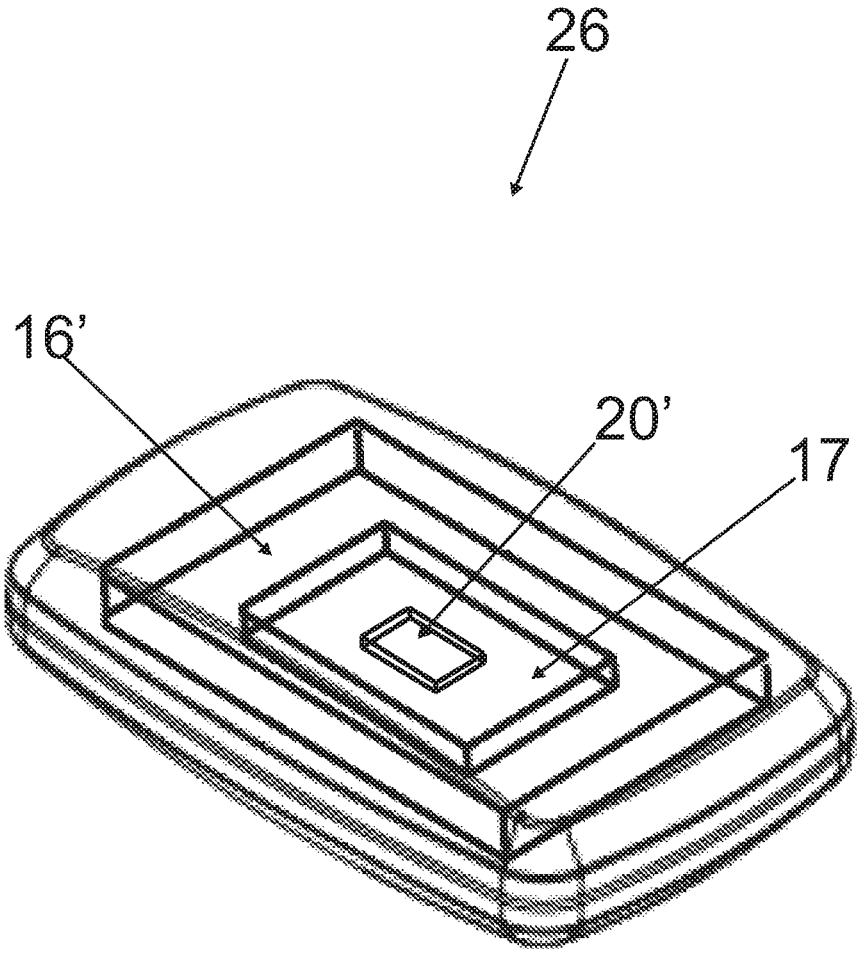
FIG. 15 is a preferred representation of an identification device comprising a radiofrequency module, electronic plate and non-volatile memory.

A preferred representation of the identification device 26 is shown in FIG. 15 of the present application. In this representation, one further observes the electronic board 16' and the radiofrequency module 17.

With regard to the dosing device, it may be powered by conventional batteries, establishing a time of use of about 1 year.

Further, the radiofrequency module 17 arranged on the dosing device 11 should comprise a maximum detection radius of preferably 1 meter. Such a characteristic prevents the system from detecting an identification tag inside the ward 2 when actually the person who has sanitized his hands was not using it.

The system 1 proposed in the present invention may further be used in hospital wards comprising more than one bed. In this case, at the moment of installing the system each object of the ward, such as beds, dosing devices and counters, are registered and their positions are informed to the software.

Further, the references to the data of use 14 from the dosing device 11 should be understood as the data of use 14 from the whole dosing assembly 11, that is to say, electronic board 16, actuation sensor 8 and radiofrequency module 17.

Additionally, the data of use 14 stored in the non-volatile memories of the dosing device 11, in the indication device 7 and of the infrared sensor 9 arranged in the envelope 18 may be read through a communication via radiofrequency individually (through a direct connection with the device itself) or through a network connection (preferably ZigBee or Bluetooth), in which the data from these elements can be transmitted to a data server.

Through this data server, one can follow in real time the acquisition of data from all the sensors installed in various hospital wards, with the possibility of following in real time the movement of professionals (tracking), location of each professional in a determined ward, time during which each professional remains in a given ward and sanitizing events with respect to the five sanitizing moments.

As can be easily observed by the description made above, the system for monitoring the hand sanitizing opportunities in hospital wards 1 proposed by the present invention is capable of configuring a method for monitoring the hand sanitizing opportunities in wards.

Basically, said method comprises the steps of:

detecting a hand sanitizing action according to a set of hand sanitizing opportunities, and indicating the occurrence of hand sanitizing action on an indication device 7 arranged close to the patient's bed.

The proposed method further comprises the steps of:

establishing a minimum power threshold 21 of the radiofrequency module 17 of the dosing device 11, verifying whether there are signals from at least one identification device 26 located inside the minimum power threshold 21.

Additionally, the proposed method comprises the step of sending the data of use 14 of the dosing device 11 (assembly of actuation sensor 8, radiofrequency module 17 and electronic board 16) to the indication device 7, and storing such data of use 14 in an internal memory 20 of the dosing device 11.

The proposed method is further capable of carrying out the step of comparing the data of use 14 from the dosing device 11 with at least one heat emitting zone 12 detected by at least one infrared sensor 9, and comparing the data of use 14 from the dosing device 11 with a handling of an invasive device 15.

Said method is further capable of carrying out the step of comparing the handling of the invasive device 15 with the heat emitting zone 12 detected by the infrared sensor 9, establishing a zone of capture of the identification tag 22 of the indication device 7 and verifying whether the data of use 14 were received by the indication device 7 when the identification device 26 gets into the zone of capture of the identification tag 22.

The proposed method further comprises the following steps:

if data of use 14 are received by the indication device 7 when the identification device 28 gets into the zone of capture of the identification tag 22, the method further comprises the step of processing a wait time in the event that the indication device 26 comes out of the zone of capture of the identification tag 22;

after the processing of the wait time, the method comprises the step of verifying whether there is an identification device 26 within the zone of capture of the identification tag 22.

Further, the method comprises the steps of:

establishing at least three objects 11, 23, 25 of the hospital ward 2, the positions of which are previously known;

identifying a new object in the ward 2, if it is not one of the three objects 11, 23, 25, the positions of which are previously known;

associating the new object to an arbitrary name E;

establishing a registration number equal to the identification number of the identification tag 26 to the arbitrary name E or, in the event that the object is not with an identification tag 26, establishing a temporary and single registration number.

Finally the method is capable of carrying out the steps of:

identifying a health professional who has performed a hand sanitizing action;

comparing a data of use 14 from the dosing device 11 with at least one heat emitting zone 12 detected by at least one infrared sensor 9;

comparing the data of use 14 from the dosing device 11 with a handling of an invasive device 15;

comparing the handling of the invasive device 15 with the heat emitting zone 12 detected by the infrared sensor 9;

sending the data of use 14 from the dosing device 11 to the indication device 7; and identifying a health professional that has performed a hand sanitizing action.

A preferred example of embodiment having been described, it should be understood that the scope of the present invention embraces other possible variations, being limited only by the contents of the accompanying claims, which include the possible equivalents.

The invention claimed is:

1. A system for monitoring hand sanitizing opportunities in a hospital ward, comprising:

a plurality of sensors arranged inside the hospital ward, capable of detecting at least one hand sanitizing action according to at least one hand sanitizing opportunity, the plurality of sensors comprising:

a dosing device for dosing aseptic substance having at least one actuation sensor for generating data of use and establishing a hand sanitizing action when the dosing device is actuated;

at least one infrared sensor capable of detecting at least one heat emitting zone generated by at least one of a human body and electrical equipment in the hospital ward, the infrared sensor being configured to receive the data of use from the dosing device and to compare the data of use with the detected heat emitting zone; and at least one movement sensor configured to detect handling of at least one invasive device, the invasive device being configured to receive the data of use from the dosing device and to compare the data of use with the handling of the invasive device; and at least one indication device for indicating a signal relating to the hand sanitizing action and the at least one hand sanitizing opportunity, the system being further configured to compare the handling of the invasive device with the detected heat emitting zone, and wherein the at least one hand sanitizing opportunity is established according to the detected heat emitting zone, the handling of the invasive device, and the comparison between the handling of the invasive device with the detected heat emitting zone.

2. The system of claim 1, wherein the infrared sensor is arranged in an envelope, the envelope further comprising a radiofrequency module.

3. The system of claim 2, wherein the invasive device is capable of further receiving the data of use from the dosing device.

4. The system of claim 3, wherein the indication device is configured so as to receive the data of use from the dosing device.

5. The system of claim 4, wherein the indication device further comprises a radiofrequency module.

6. The system of claim 5, wherein the data of use from the dosing device is transmitted via radiofrequency to the indication device for indicating the occurrence of the hand sanitizing action.

7. The system of claim 6, wherein the data of use from the dosing device is transmitted via radiofrequency to the indication device for identifying a health professional who has performed the hand sanitizing action.

8. A method for monitoring hand sanitizing opportunities in a hospital ward, comprising:

generating data of use when a dosing device in the hospital ward for dosing aseptic substance is actuated, the actuation of the dosing device establishing a hand sanitizing action;

detecting at least one heat emitting zone generated by at least one of a human body and electrical equipment disposed in the hospital ward by at least one infrared sensor;

detecting handling of at least one invasive device;

comparing the data of use with the detected heat emitting zone;

comparing the data of use with the handling of the invasive device;

comparing the handling of the invasive device with the detected heat emitting zone;

establishing at least one hand sanitizing opportunity according to the detected heat emitting zone; and indicating a signal relating to the hand sanitizing action and the at least one hand sanitizing opportunity on an indication device.

9. The method of claim 8, further comprising:

establishing a minimum power threshold of a radiofrequency module of the dosing device.

10. The method of claim 9, further comprising:

verifying whether there are signals from at least one identification device located within the minimum power threshold.

11. The method of claim 10, regardless of the existence of signals from at least one identification device within the minimum power threshold, further comprising:

sending the data of use from the dosing device to the indication device; and storing the data of use in an internal memory of the dosing device.

12. The method of claim 11, further comprising the steps of:

establishing a zone of capture of an identification tag of the indication device; and verifying whether the data of use was received by the indication device when the identification device gets into the zone of capture of the identification tag.

13. The method of claim 12, wherein if the data of use is received by the indication device when the identification device gets into the zone of capture of the identification the method comprises:

processing a wait time if the indication device comes out of the zone of capture of the identification tag.

14. The method of claim 13, wherein after the processing of the wait time, the method comprises:

verifying whether the indication device is within the zone of capture of the identification tag.

15. The method of claim 14, comprising:

establishing at least three objects of the hospital ward, the positions of which are previously known;

identifying a new object ion the ward, if the latter is not one of the three objects the positions of which are previously known;

associating the new object to an arbitrary name (A); and establishing a registration number (#042) to the arbitrary name (A).

16. The method of claim 13, comprising:

identifying a health professional that has performed the hand sanitizing action.

17. The system of claim 1, wherein the movement sensor comprises an accelerometer.

18. The system of claim 1, wherein the at least one invasive device is a catheter.

19. The method of claim 8, wherein the at least one invasive device is a catheter.

20. A system for monitoring hand sanitizing opportunities in a hospital ward, comprising:

a plurality of sensors arranged inside the hospital ward, capable of detecting at least one hand sanitizing action according to at least one hand sanitizing opportunity, the plurality of sensors comprising:

a dosing device for dosing aseptic substance having at least one actuation sensor for generating data of use and establishing a hand sanitizing action when the dosing device is actuated;

at least one infrared sensor capable of detecting at least one heat emitting zone generated by at least one of a human body and electrical equipment in the hospital ward, the infrared sensor being configured to receive the data of use from the dosing device and to compare the data of use with the detected heat emitting zone; and at least one movement sensor configured to detect handling of at least one invasive device, the invasive device being configured to receive the data of use from the dosing device and to compare the data of use with the handling of the invasive device;

at least one indication device for indicating a signal relating to the hand sanitizing action and the at least one hand sanitizing opportunity; and at least one identification tag for identifying a user within a zone of capture, the system being configured to process a wait time when the identification tag is out of the zone of capture and verify whether the user returns to zone of capture within the wait time, the system being further configured to compare the handling of the invasive device with the detected heat emitting zone, and wherein the at least one hand sanitizing opportunity is established according to the detected heat emitting zone, the handling of the invasive device, and the comparison between the handling of the invasive device with the detected heat emitting zone.

21. A method for monitoring hand sanitizing opportunities in a hospital ward, comprising:

generating data of use when a dosing device in the hospital ward for dosing aseptic substance is actuated, the actuation of the dosing device establishing a hand sanitizing action;

detecting at least one heat emitting zone generated by at least one of a human body and electrical equipment disposed in the hospital ward by at least one infrared sensor;

detecting handling of at least one invasive device;

comparing the data of use with the detected heat emitting zone;

comparing the data of use with the handling of the invasive device;

comparing the handling of the invasive device with the detected heat emitting zone;

establishing at least one hand sanitizing opportunity according to the detected heat emitting zone;

indicating a signal relating to the hand sanitizing action and the at least one hand sanitizing opportunity on an indication device;

identifying an identification tag of a user within a zone of capture;

processing a wait time if the user comes out of the zone of capture of the identification tag; and verifying whether the user returns to the zone of capture after the processed wait time.

22. The method of claim 21, wherein the wait time is about 1 minute.

* * * * *